US006602833B1

(12) United States Patent
Skold

(10) Patent No.: US 6,602,833 B1
(45) Date of Patent: Aug. 5, 2003

(54) MECHANICAL WORKING IN THE PRESENCE OF A METAL CONTAINING COPPER OR ALUMINUM

(75) Inventor: Rolf Skold, Stenungsund (SE)

(73) Assignee: AB Chem Dimension, Stenungsund (SE)

( * ) Notice: Subject to any disclaimer, the term of this patent is extended or adjusted under 35 U.S.C. 154(b) by 0 days.

(21) Appl. No.: 09/786,129

(22) PCT Filed: Sep. 3, 1999

(86) PCT No.: PCT/SE99/01521

§ 371 (c)(1),
(2), (4) Date: Apr. 30, 2001

(87) PCT Pub. No.: WO00/14191

PCT Pub. Date: Mar. 16, 2000

(30) Foreign Application Priority Data

Sep. 7, 1998 (SE) ..... 9803005

(51) Int. Cl.[7] ..... C10M 173/02

(52) U.S. Cl. ..... 508/423; 508/431; 508/506; 508/539; 508/562; 72/42

(58) Field of Search ..... 508/562, 431, 508/423

(56) References Cited

U.S. PATENT DOCUMENTS 4,313,836 A 2/1982 Nassry et al. ..... 508/276
4,384,965 A * 5/1983 Hellsten et al. ..... 252/32.5
4,521,321 A * 6/1985 Anderson et al. ..... 252/49.3
4,828,737 A * 5/1989 Sandberg et al. ..... 252/49.3
4,859,351 A * 8/1989 Awad ..... 252/32.5
4,976,919 A * 12/1990 Skold et al. ..... 422/7
5,132,046 A * 7/1992 Edebo et al. ..... 252/49.3
5,431,834 A * 7/1995 Skold ..... 252/51.5 R
5,561,104 A * 10/1996 Miyagawa et al. ..... 508/421
5,932,526 A * 8/1999 Person Hei et al. ..... 508/559
6,103,675 A * 8/2000 Pyka et al. ..... 508/438
6,191,079 B1 * 2/2001 Klima et al. ..... 508/431

FOREIGN PATENT DOCUMENTS

EP A1180561 5/1986
EP A2192358 8/1986

* cited by examiner

*Primary Examiner*—Ellen M. McAvoy
(74) *Attorney, Agent, or Firm*—Birch, Stewart, Kolasch & Birch, LLP

(57) ABSTRACT

The present invention is directed to a method for mechanical working of a metal containing copper, aluminum or an alloy thereof. The method is carried out in the presence of an aqueous cooling lubricant containing an alkanol amine. The lubricant is capable of preventing and reducing the corrosion of both metals and iron.

15 Claims, No Drawings

MECHANICAL WORKING IN THE PRESENCE OF A METAL CONTAINING COPPER OR ALUMINUM

This application is the national phase under 35 U.S.C. §371 of PCT International Application No. PCT/SE99/01521 which has an International filing date of Sep. 3, 1999, which designated the United States of America.

The present invention relates to a method for mechanical working of a metal containing copper, aluminum or an alloy thereof The method is carried out in the presence of an aqueous cooling lubricant containing an alkanol amine. Preferably the alkanol amine is used in combination with a phosphate ester or a carboxylic acid. The lubricant is capable of reducing or preventing the corrosion of both metals as well as iron. In addition it also contributes in an essential way to the lubrication.

Aluminum and copper and alloys of these metals are among the most common construction metals. The mechanical working is usually performed in the presence of an aqueous cooling lubricant. A disadvantage of many aqueous cooling lubricants is that they frequently contain an iron corrosion inhibitor, such as monoethanolamine, diethanolamine or triethanolamine, which has a detrimental effect on copper, aluminum or alloys thereof and causes discoloration and dissolution. Beside the corrosion, any dissolved metal also constitutes an environmental hazard and is difficult to remove from water in the process of disposal of the cooling lubricant.

In order to mitigate the negative effects of alkanol amine, anionic surface active components with long aliphatic groups, such as groups with 14–44 carbon atoms have been used. Exemplary components are phosphate esters and fatty acids and dimer acids. Their protective action depends on the formation of insoluble, organic layers on the metal surfaces. If, however, dissolved di- or trivalent metals exist in the cooling lubricant, the anionic components will form insoluble salts with these metals ions. This may sometimes further increase the corrosion inhibiting effect, but it will also lead to the formation of an undesirable sticky precipitation, which e.g. tend to interfere with the cleaning of the cooling lubricant. Another drawback is the difficulty to remove the hydrophobic layers formed on the metal surfaces. If they are not removed, they will cause problems in the subsequent surface treatment, for example pickling, phosphatizing, galvanizing or other metal depositing processes. The presence of the long chain anionic components may also cause undesirable foaming and scum.

U.S. Pat. No. 4,315,889 discloses a method of reducing the release of cobalt by performing the metal working in the presence of a cooling lubricant containing, as an active component, a specific triazole or thiadiazole compound. However, since these active compounds are consumed in the presence of ethanolamines, the aqueous cooling lubricant has to be regularly upgraded.

EP-A-0180561 describes the use of a tertiary alkanol amine compound for reducing the release of cobalt. According to the application the tertiary alkanol amine compound can advantageously be combined with carboxylic acids for further protection against the release of cobalt and the corrosion of iron.

According to the present invention it has now been found possible to reduce or eliminate the above mentioned problems by using certain alkanol amines, which do not dissolve or discolor copper or aluminum metals. In more detail, the present invention relates to a process for the mechanical working of metals containing copper, aluminum or alloys thereof, which process is performed in the presence of an aqueous cooling lubricant having a pH of 6–10 and containing an alkanol amine of the formula $$N(R_3)(R_4)(R_5) \quad \text{(I)},$$

where $R_3$, $R_4$ and $R_5$ independently of each other designate a group $(AO)_nH$, where AO is an ethyleneoxy group or a propyleneoxy group and n is a number from 2–6, and the number of ethyleneoxy groups in relation to the number of propyleneoxy groups is between 2:1 and 1:3.

Particular effective in avoiding the side effects of conventional iron corrosion inhibiting components in earlier used formulations are according to the invention aqueous cooling lubricants in which the alkanol amine I are supplemented by a short chain anionic compound selected from the group consisting of a phosphate ester of the formula $$R_1(\text{oxyalkylene})_nOP(O)(X)(OH) \quad \text{(II), or}$$

$$(HO)_2(O)P\text{-}(\text{oxyalkylene})_m\text{-}OP(O)(OH)_2 \quad \text{(III)},$$

where $R_1$ is an alkyl group with 1–12 carbon atoms. X is hydroxyl or the group $R_1O$, where $R_1$ has the above mention meaning, oxyalkylene is a group containing 2–4 carbon atoms, n is a number from 1–15 and m is a number from 4–20, or a salt thereof, or a carboxylic acid of the formula $$R_2(COOH)_p \quad \text{(IV)},$$

where $R_2$ is an alkyl group with 4–10 carbon atoms and p is 1 or 2, or a salt thereof, or a mixture of any of the anionic compounds III II and IV. The total amount of the anionic compounds II, III and IV is normally 10–1000%, preferably 15–300% by weight of the alkanol amine I. The alkanol amine I, preferably in combination with at least one of the anionic compounds II, III and IV, results in an essential reduction in the amount of dissolved copper and discolored copper and aluminum in comparison with a corrosion inhibitor consisting of a carboxylic acid and an alkanol amine, such as triethanolamine. The compounds I, II, III and IV also contribute to the lubrication.

The alkanol amine I contains always at least 2 propyleneoxy groups. Preferably the alkanol amines are produced by ethoxylation of ammonia with 2–4 moles ethylene oxide followed by propoxylation with 4–7 moles per mole ammonia. The hydroxyl groups of these alkanol amines will consist of only secondary hydroxyl groups. The ratio of ethyleneoxy groups to propyleneoxy groups is preferably between 1:1 and 1:3.

The carboxylic acid of formula IV contains an aliphatic group which can be saturated or unsaturated, straight or branched. Preferably the aliphatic group of monocarboxylic acids contains 5–9 carbon atoms, while the dicarboxylic acids preferably have an aliphatic group with 6–10 carbon atoms. Suitable examples of carboxylic acids are azelaic acid, pelargonic acid, sebacic acid, isononanoic acid, neodecanoic acid, n-octanoic acid, n-decanoic acid and dodecandioic acid. The carboxylic acids having a branched aliphatic group of the preferred size are often utilized, since they are low foaming.

In the phosphate esters of formulae II and III, the $(\text{oxyalkylene})_n$ group and $(\text{oxyalkylene})_m$ group respectively, are suitable selected in such a way that the esters will be water-soluble or easily dispersible in water.

The aliphatic group $R_1$ can be saturated or unsaturated, straight or branched and contains preferably 2–8 carbon atoms. Preferably the phosphate ester with formula II consists of at least 50% by weight of monoesters. In formula III the polyoxyalkylene chain preferably consists, at least partially, of oxyalkylene groups with 3–4 carbons atoms and m preferably is at least 6, since these diphosphate esters beside the corrosion inhibiting effect give a considerable contribution to the lubrication Especially suitable are those diphosphate esters, which contains a polyoxypropypene chain with 5–10 oxypropylene units.

The content of the alkanol amine I and the anionic compounds II, III and IV may vary within wide limits, but is normally between 0.1 and 10% by weight, preferably between 1 and 7% by weight of the cooling lubricant ready for use. The cooling lubricant can also contain a number of other additives, such as additional corrosion-inhibiting additives and lubricants, pH-regulating or controlling additives, bactericidal agents, viscosity-increasing additives, solubilizers, perfumes, colourants etc.

Examples of suitable additional corrosion inhibitors are amines compounds, such as triazole and thiadiazole compounds, and inorganic compounds, such as alkali metal hydroxides and boric acid, and reaction products between boric acid and/or carboxylic acids with organic compounds, such as alkanol amines. The content of these additional corrosion inhibitors may be up to 3% by weight of the cooling lubricant.

Although the cooling lubricant containing the alkanolamine I and the anionic surfactants II, III and IV has an adequate lubrication ability for most applications it may be occasions where improved lubrication is desired. Examples of suitable lubricants to be incorporated into a cooling lubricant according to the invention are those selected from the group consisting of esters or amides of mono- or dicarboxylic acids having at least 12 carbon atoms in the acyl groups, aliphatic phosphate esters containing one or two aliphatic groups with 6–18 carbon atoms, nonionic alkylene oxide adducts with a molecular weight above 400, such as polypropylene glycols, glycols of randomly distributed propyleneoxy and ethyleneoxy groups and block polymers of propylene oxide and ethylene oxide, and mixtures thereof The content of these additional lubricants may be up to 3% by weight of the cooling lubricant ready for use.

The solubilizers are usually low molecular compounds containing at least one hydroxyl. The molecular weight is normally below 400. Examples of suitable solubilizers are propypeneglycol, ethylene diethyleneglycol, butyl diethyleneglycol and butyl triethyleneglycol.

When preparing a cooling lubricant according to the invention, it is suitable to first prepare a concentrate, for example by first mixing the alkanol amine I, anionic compounds II, III and IV and water, and then the supplementary ingredients. The amount of water is suitably between 5–80% by weight of the concentrate. A typical concentrate according to the invention has the following composition:

| | |
|---|---|
| alkanol amine I | 20–95, preferably 50–90% by weight |
| anionic compounds II, III and IV | 0–60, preferably 10–50% by weight |
| additional corrosion inhibitors | 0–30, preferably 0–15% by weight |
| additional lubricants | 0–30, preferably 0–15% by weight |
| water | 5–80, preferably 10–50% by weight |
| other ingredients | 0–30, preferably 0–15% by weight |

The total amount of the additional corrosions inhibitors and lubricants and other ingredients is often 5–40% by weight of the concentrate. Before the concentrate is used, it is diluted with water so that the cooling lubricant ready for use will have a total content of 0.5–20% by weight, preferably 2–10% by weight.

The present invention is further illustrated by the following Examples.

EXAMPLE 1

Cooling lubricants ready for use were prepared from the aqueous concentrates in the Table 1 below. The content of water was 30% by weight. The pH of the concentrates was adjusted to 9 by adding KOH before they were diluted with water to an active content of 4% by weight. The corrosion inhibiting effects on copper and iron of these fluids were determined at an ambient temperature of 22° C. by the following test methods.

Fe-corrosion tests were done by placing 30 grams of cast iron chips evenly spread on a circular filter paper with a diameter of 90 mm. 1.25 gram of one of the cooling lubricants was dispensed at the center of the filter paper, which was placed in a plastic Petri dish and covered by a lid. The corrosion taken place after 24 hours was determined by visually inspection of the rust staining according to a scale, where 0=no corrosion, 1=one stain, 2=two or three stains, 3=more than three stains up to 10% of the paper surface discolored, 4=between 10 and 25% of the paper surface discolored, and 5=more than 25% of the paper surface discolored.

Cu-corrosion tests were performed by assessing the amount of leached copper obtained, when a 20 ml glass vial containing 5 glass beads, 5 mg of fine powder of copper and 10 ml of one of the fluids was shaken for 7 days. The amount of copper dissolved was measured by use of an atomic absorption spectrophotometer (AAS). Initial screening of the fluids was done by using analytical sticks from Merck and only samples, which were found to contain less than 30 ppm of copper, were subjected to AAS analysis.

The results obtained from the corrosion tests are shown in Table 2.

TABLE 1

| | Aqueous concentrates | | | | | | | |
|---|---|---|---|---|---|---|---|---|
| Components % by weight | I | II | III | IV | V | VI | VII | VIII |
| Composition 1 | 20 | — | — | — | 50 | — | — | — |
| 2 | 20 | — | — | — | — | 50 | — | — |
| 3 | 20 | — | — | — | — | — | 50 | — |
| 4 | 20 | — | — | — | — | — | — | 50 |
| 5 | — | 20 | — | — | 50 | — | — | — |
| 6 | — | 20 | — | — | — | 50 | — | — |
| 7 | — | 20 | — | — | — | — | 50 | — |
| 8 | — | 20 | — | — | — | — | — | 50 |
| 9 | — | — | 20 | — | 50 | — | — | — |
| 10 | — | — | 20 | — | — | 50 | — | — |
| 11 | — | — | 20 | — | — | — | 50 | — |
| 12 | — | — | 20 | — | — | — | — | 50 |
| 13 | — | — | — | 20 | 50 | — | — | — |
| 14 | — | — | — | 20 | — | 50 | — | — |
| 15 | — | — | — | 20 | — | — | 50 | — |
| 16 | — | — | — | 20 | — | — | — | 50 |
| 17 | 10 | — | 10 | — | 50 | — | — | — |
| 18 | 10 | — | 10 | — | — | 50 | — | — |
| 19 | 10 | — | 10 | — | — | — | 50 | — |
| 20 | 10 | — | 10 | — | — | — | — | 50 |
| 21 | 10 | — | — | 10 | 50 | — | — | — |
| 22 | 10 | — | — | 10 | — | 50 | — | — |

TABLE 1-continued

| Components % by weight | I | II | III | IV | V | VI | VII | VIII |
|---|---|---|---|---|---|---|---|---|
| | Aqueous concentrates | | | | | | | |
| 23 | 10 | — | — | 10 | — | — | 50 | — |
| 24 | 10 | — | — | 10 | — | — | — | 50 |
| 25 | — | 10 | 10 | — | 50 | — | — | — |
| 26 | — | 10 | 10 | — | — | 50 | — | — |
| 27 | — | 10 | 10 | — | — | — | 50 | — |
| 28 | — | 10 | 10 | — | — | — | — | 50 |
| 29 | — | 10 | — | 10 | 50 | — | — | — |
| 30 | — | 10 | — | 10 | — | 50 | — | — |
| 31 | — | 10 | — | 10 | — | — | 50 | — |
| 32 | — | 10 | — | 10 | — | — | — | 50 |

Component I=phosphate ester, where $R_1$=hexyl, oxyalkylene=oxyethylene, n=5, X=hydroxyl, Component II=diphosphate, where oxyalkylene=oxypropylene, m=9, Component III=isononanoic acid, Component IV=neodecanoic acid, Component V=triethanolamine Component VI=triethanolamine+4 propylene oxide, Component VII=triethanolamine+5 propylene oxide, and Component VIII=triethanolamine+6 propylene oxide

TABLE 2

| Corrosion test results | | | | | | | | |
|---|---|---|---|---|---|---|---|---|
| Composition | 1 | 2 | 3 | 4 | 5 | 6 | 7 | 8 |
| Fe-corrosion | 0 | 0 | 1 | 3 | 0 | 0 | 2 | 3 |
| Cu-corrosion ppm | 350 | 20 | 20 | 10 | 350 | 30 | 30 | 10 |
| Composition | 9 | 10 | 11 | 12 | 13 | 14 | 15 | 16 |
| Fe-corrosion | 0 | 0 | 1 | 0 | 0 | 1 | 1 | 2 |
| Cu-corrosion ppm | 350 | 50 | 50 | 15 | 350 | 30 | 20 | 10 |
| Composition | 17 | 18 | 19 | 20 | 21 | 22 | 23 | 24 |
| Fe-corrosion | 0 | 0 | 1 | 0 | 0 | 0 | 0 | 1 |
| Cu-corrosion ppm | 350 | 20 | 10 | 5 | 350 | 10 | 10 | 10 |
| Composition | 25 | 26 | 27 | 28 | 29 | 30 | 31 | 32 |
| Fe-corrosion | 0 | 0 | 0 | 1 | 0 | 0 | 0 | 0 |
| Cu-corrosion ppm | 350 | 20 | 10 | 5 | 350 | 10 | 5 | 5 |

From the results it is evident that the metal working fluids formulated according to the invention, namely compositions 2–4, 6–8, 10–12, 14–16, 18–20, 22–24, 26–28 and 30–32 have excellent corrosion inhibiting properties as regards copper and are superior to the comparison fluids 1, 5, 9, 13, 17, 21, 25 and 29. The iron corrosion inhibiting properties of the formulations according to the invention are acceptable and in all tests zero iron corrosion were obtained, when the concentration of the active components was raised to 5,5% by weight.

EXAMPLE 2

Since brass and aluminum are often used in applications where visual appearance is important an immersion test was performed to show the degree of discoloration caused by the test solutions. Strips of 5 mm width and 60 mm length of each metal were placed in separate glass vials and tests solutions were added to cover half the length of the upright standing strips. The corrosion was visually determined after 7 days. The discoloration of the strips was measured according to a scale from 0 to 5, where 0 represent no corrosion, 1 indicate that up to 5% of the surface is black, 2 that 5–10% of the surface is black, 3 that 10–25% of the surface is black, 4 that 25–90% of the surface is black, and 5 that 90–100% of the surface is black. For the brass strips it was also noted if the test solutions were colored blue.

The following results were obtained. The compositions with their numbers corresponds to the compositions in Example 1.

TABLE 3

| Composition no | 1 | 4 | 5 | 8 | 9 | 12 |
|---|---|---|---|---|---|---|
| Brass | | | | | | |
| -corrosion degree | 5 | 0 | 5 | 0 | 5 | 1 |
| -solution | blue | — | blue | — | blue | — |
| Aluminum | 5 | 0 | 5 | 0 | 5 | 0 |
| Composition no | 13 | 16 | 20 | 24 | 28 | 32 |
| Brass | | | | | | |
| -corrosion degree | 5 | 2 | 1 | 1 | 0 | 1 |
| -solution | blue | light blue | — | light blue | — | light blue |
| Aluminum | 5 | 0 | 0 | 0 | 0 | 0 |

From the results it is evident that the solution according to the invention are superior to the comparison solutions based on triethanolamine.

What is claimed is:

1. A method for mechanically working of a metal containing copper, aluminum or an alloy thereof comprising the use of an aqueous cooling lubricant having a pH between 6 and 10 and containing an alkanol amine of the formula $$N(R_3)(R_4)(R_5) \quad \text{(I)},$$

where $R_3$, $R_4$ and $R_5$ independently of each other designate a group $(AO)_nH$, where AO is an ethyleneoxy group or a propyleneoxy group and n is a number from 2–6, the number of ethyleneoxy groups in relation to the number of propyleneoxy groups is between 2:1 and 1:3.

2. A method according to claim 1, wherein the alkanol amine I has three secondary hydroxyl groups.

3. A method according to claim 2, wherein the alkanol amine is obtained by ethoxylation of 1 mole ammonia with 2–4 moles ethylene oxide followed by propoxylation with 4–7 moles propylene oxide.

4. The method according to claim 1, wherein the lubricant also contains an anionic compound selected from the group consisting of a phosphate ester of the formula $$R_1(\text{oxyalkylene})_nOP(O)(X)(OH) \quad \text{(II), or}$$

$$(HO)_2(O)P\text{-}(\text{oxyalkylene})m\text{-}OP(O)(OH)_2 \quad \text{(III)},$$

where $R_1$ is an alkyl group with 1–12 carbon atoms, X is hydroxyl or the group $R_1O$, where $R_1$ has the above mentioned meaning, oxyalklene is a group containing 2–4 carbon atoms, n is a number form 1–15 and m is a number from 4–20, or a salt thereof, or a carboxylic acid of the formula $$R_2(COOH)_p \quad \text{(IV)},$$

where $R_2$ is an alkyl group with 6–12 carbon atoms and p is 1 or 2, or a salt thereof, or a mixture thereof.

5. A method according to claim 4, wherein the phosphate ester III contains a polyoxyalkylene chain, which at least partially consists of oxyalkylene groups with 3–4 carbon atoms, and the phosphate ester II consists of at least 50% by weight of monoesters.

6. A method according to claim 3, wherein that the carboxylic acid of formula IV is a monocarboxylic acid, where $R_2$ is a branched aliphatic group with 5–9 carbon atoms or a dicarboxylic acid, where $R_2$ is a branched aliphatic group with 6–10 carbon atoms.

7. A method according to claim 4, wherein the cooling lubricant contains at least one phosphate ester of formula II or III and a carboxylic acid of formula IV.

8. The method of claim 4, wherein the phosphate ester has the formula III.

9. An aqueous lubricant composition having a pH between 6 and 10 which comprises:

an alkanol amine of the formula $$N(R_3)(R_4)(R_5) \quad \text{(I)},$$

wherein $R_3$, $R_4$ and $R_5$ independently of each other designated a group $(AO)_nH$, where AO is an ethyleneoxy group or a propyleneoxy group and n is a number from 2–6, the number of ethyleneoxy groups in relation to the number of propyleneoxy group is between 2:1 and 1:3;

an anionic compound selected from the group consisting of a phosphate ester of the formula $$R_1(\text{oxyalkylene})_nOP(O)(X)(OH) \quad \text{(II), or}$$

$$(HO)_2(O)P\text{-}(\text{oxyalkylene})m\text{-}OP(O)(OH)_2 \quad \text{(III)},$$

where $R_1$ is an alkyl group with 1–12 carbon atoms, X is hydroxyl or the group $R_1O$, where $R_1$ is an alkyl group with 1–12 carbon atoms, oxyalklene is a group containing 2–4 carbon atoms, n is a number from 1–15 and m is a number from 4–20, or a salt thereof;

and a carboxylic acid of the formula $$R_2(COOH)_p \quad \text{(IV)},$$

where $R_2$ is an alkyl group with 6–12 carbon atoms and p is 1 or 2, or a salt thereof, or a mixture thereof;

wherein the alkanol amine I is present in an amount of 50–90% by weight, the anionic compounds II, III and IV are present in an amount of 10–50% by weight, with the substantial balance being water.

10. The composition according to claim 9, wherein the total amount of additional corrosion inhibitors, additional lubricants and other ingredients is 5–40% by weight.

11. The composition according to claim 9, wherein the water is present in an amount of 10–50% by weight.

12. The composition according to claim 10, wherein the additional corrosion inhibitors are present in an amount of 0–15% by weight and the additional lubricants are present in an amount of 0–15% by weight.

13. The aqueous lubricant composition of claim 9, wherein the phosphate ester has the formula III.

14. The aqueous lubricant composition of claim 9, for mechanically working a metal containing copper, aluminum or alloys thereof.

15. The aqueous lubricant composition of claim 9, wherein the phosphate ester has the formula III.

* * * * *